US009010011B2

(12) United States Patent
Trapp et al.

(10) Patent No.: US 9,010,011 B2
(45) Date of Patent: Apr. 21, 2015

(54) MOUNTING FOR THE DETACHABLE ATTACHMENT OF AN AIMING DEVICE FOR A HANDGUN

(71) Applicant: L&O Hunting Group GmbH, Isny (DE)

(72) Inventors: Florian Trapp, Sundern (DE); Florian Hasler, Wangen im Allgaeu (DE)

(73) Assignee: L & O Hunting Group GmbH, Isny (DE)

( * ) Notice: Subject to any disclaimer, the term of this patent is extended or adjusted under 35 U.S.C. 154(b) by 46 days.

(21) Appl. No.: 13/872,608

(22) Filed: Apr. 29, 2013

(65) Prior Publication Data

US 2013/0283659 A1 Oct. 31, 2013

(30) Foreign Application Priority Data

Apr. 30, 2012 (DE) ..... 10 2012 103 792

(51) Int. Cl.
*F41G 1/00* (2006.01)
*F41G 11/00* (2006.01)

(52) U.S. Cl.
CPC ..... *F41G 1/00* (2013.01); *F41G 11/001* (2013.01); *F41G 11/003* (2013.01)

(58) Field of Classification Search
USPC ..... 42/90, 111, 124, 125, 126, 127, 148
See application file for complete search history.

(56) References Cited

U.S. PATENT DOCUMENTS

| | | | | |
|---|---|---|---|---|
| 3,153,856 | A * | 10/1964 | Felix | 42/127 |
| 3,579,840 | A | 5/1971 | Heinzel | |
| 3,750,318 | A * | 8/1973 | Burris | 42/127 |
| 4,688,345 | A * | 8/1987 | Kilgour | 42/127 |
| 6,442,883 | B1 | 9/2002 | Waterman et al. | |
| 6,598,333 | B1 | 7/2003 | Randazzo et al. | |
| 6,705,038 | B2 | 3/2004 | Davenport et al. | |
| 6,886,287 | B1 * | 5/2005 | Bell et al. | 42/120 |
| 7,334,366 | B2 * | 2/2008 | La France | 42/146 |
| 7,624,528 | B1 * | 12/2009 | Bell et al. | 42/139 |
| 7,669,359 | B2 * | 3/2010 | Kim | 42/124 |
| 7,814,698 | B2 * | 10/2010 | Fluhr et al. | 42/127 |
| 7,827,724 | B1 * | 11/2010 | Spinelli | 42/124 |
| 8,336,247 | B2 * | 12/2012 | Haering | 42/127 |
| 8,453,369 | B1 * | 6/2013 | Kincaid et al. | 42/124 |
| 8,468,930 | B1 * | 6/2013 | Bell | 89/204 |
| 8,893,422 | B2 * | 11/2014 | Wolf | 42/111 |
| 2014/0013644 | A1 * | 1/2014 | Trapp | 42/90 |

FOREIGN PATENT DOCUMENTS

WO 9207230 A1 4/1992

* cited by examiner

*Primary Examiner* — Michael David
(74) *Attorney, Agent, or Firm* — Fleit Gibbons Gutman Bongini & Bianco PL; Martin Fleit; Paul D. Bianco

(57) ABSTRACT

A mounting device for the detachable attachment of an aiming device on a handgun with a holding device which includes the clamping jaws for the detachable attachment of the holding device to the handgun and at least one recoil cleat for the positive locking engagement on the handgun. In order to enable a stable and accurately reproducible attachment of an aiming device, the recoil cleat includes two mutually facing and mutually separate engagement elements for the engagement in two mutually separate recesses on the handgun.

10 Claims, 2 Drawing Sheets

MOUNTING FOR THE DETACHABLE ATTACHMENT OF AN AIMING DEVICE FOR A HANDGUN

FIELD OF THE INVENTION

The invention relates to a mounting device for the detachable attachment of an aiming device to a handgun. The invention further relates to a housing of a handgun, which comprises an attachment device for such a mount.

BACKGROUND

Such a mounting device is known from U.S. Pat. No. 3,579,840. Therein, in each case a fixed clamping jaw as well as an adjustable clamping jaw on the opposite side are arranged on a ring-shaped holding device. On the bottom side of the ring-shaped holding device, between the two clamping jaws, a bar-shaped recoil cleat is provided for the engagement in a corresponding continuous transverse groove on a base portion which can be attached to the handgun. By means of the recoil cleat, the forces acting at the time of the firing are absorbed, and as a result an improved precision can be achieved. However, as a result of the continuous transverse grooves, the attachment device is also weakened, and thus the stiffness is affected.

SUMMARY OF THE INVENTION

The invention relates to a mounting device and a housing of a handgun for such a mounting device, which enable a stable and accurately reproducible attachment of an aiming device.

In the mounting device according to the invention, the recoil cleat comprises two mutually facing and mutually separate engagement elements for the engagement in two mutually separate recesses on the handgun. The housing, which is part of the mounting device, contains an attachment device which comprises two mutually facing recesses that are separated from each other by a middle bar, for the engagement of the engagement elements on the recoil cleat. By means of the middle bar, an additional stability on the housing is achieved, which allows an improved precision, and a high repetition accuracy during the mounting of an aiming device. The repelling forces acting at the time of the firing can be absorbed better, and an extremely precise positive locking connection is nevertheless achieved, between the mounting device and the housing or system casing, or the other portions of the handgun, making possible a high and consistent aiming precision, even after repeated removal and renewed mounting of the aiming device.

It is preferable to form a slot for receiving a middle bar extending in the longitudinal direction on the handgun, between the two engagement elements of the recoil cleat. As a result, an accurate and precise connection and additional lateral guidance between the mounting device and the handgun are achieved.

In a further advantageous embodiment, the recoil cleat comprises a base body which is arranged in a bore of the holding device, and on which the engagement elements can be formed. By means of the, for example, circular, base body, the recoil cleat can be arranged in a bore on the bottom side of the holding device.

In a further advantageous embodiment, the engagement elements opposite the mutually facing clamping jaws, and also the recesses for the engagement elements opposite the recesses for the clamping jaws are offset toward the front or the rear in the longitudinal direction of the holding device or of the attachment device. As a result, the clamping area of the clamping jaws is not limited.

In a particularly stable embodiment which is easy to mount, the holding device is configured in the shape of a mounting bridge having front and rear clamping jaws. However, the holding device can also be formed as a single mounting. It is also possible to attach an aiming telescope or another aiming device to a handgun by means of two, for example, ring-shaped, individual mountings.

The attachment device is preferably integrated in the housing, and it can contain two mounting bases that are separated from each other in the longitudinal direction of the housing, on which in each case two facing recesses are provided for the clamping jaws and in each case two groove-shaped recesses for the recoil cleat, which extend transversely to the longitudinal direction of the housing and which are separated by a middle bar from each other in each case.

BRIEF DESCRIPTION OF THE DRAWINGS

Further special features and advantages of the invention can be obtained from the following description of a preferred embodiment in reference to the drawing. The drawings show.

DETAILED DESCRIPTION

Figure 1:
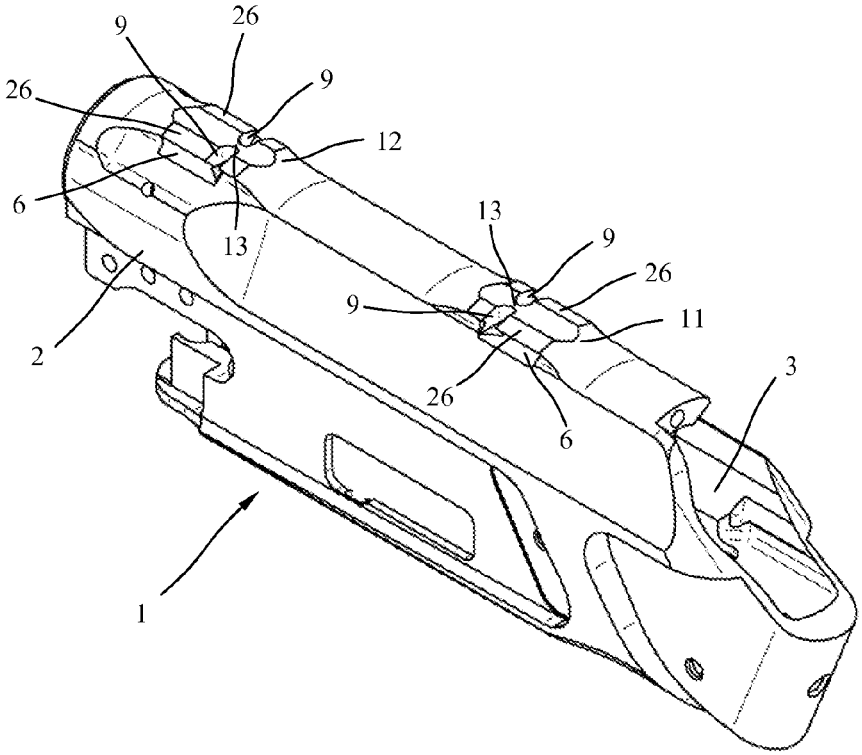
FIG. 1: a system casing of a repeater rifle with an attachment device for a mounting device for an aiming device in a perspective view.

In FIG. 1, a housing 1 of a repeater rifle is shown, which housing is configured as a system casing or a breech casing. The housing 1 comprises on its front end a sleeve-shaped barrel holder 2 for the detachable attachment of a barrel. Furthermore, on the housing 1, a recess 3 for receiving a breech of the repeater rifle is provided. On the housing 1, next to the barrel, in a manner which in itself is known, a fore end of the barrel, which is not shown, and a rear end of the barrel, which is also not represented, of the repeater rifle are attached. For the detachable attachment of an aiming telescope or of another aiming device, the housing 1 comprises additionally on its upper side an attachment device for a mounting device 4 shown in FIG. 2.

Figure 2:
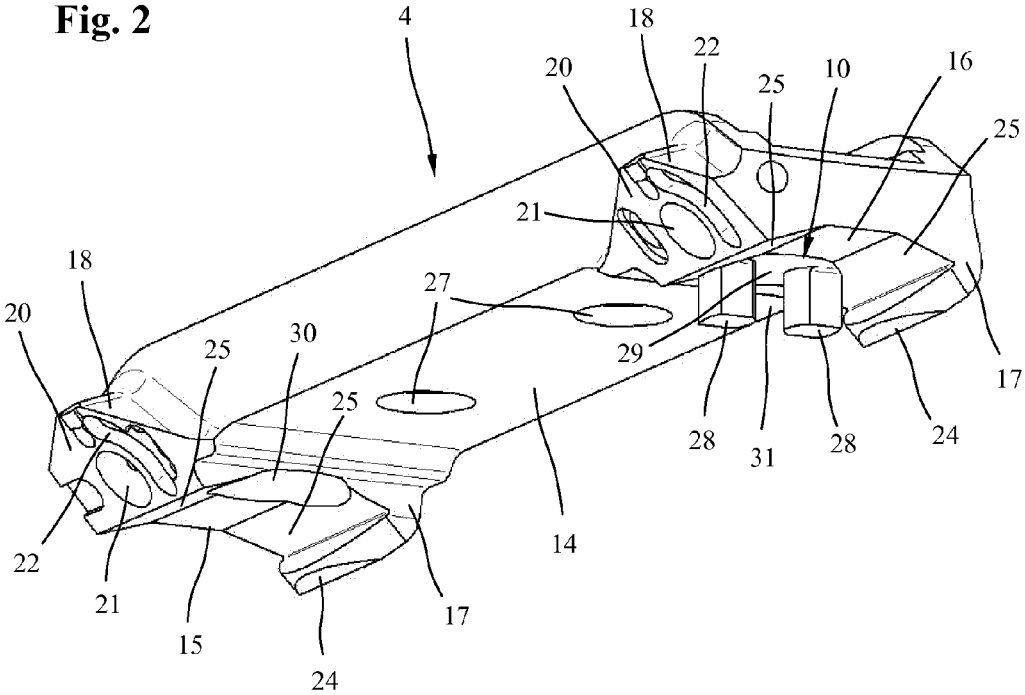
FIG. 2: a mounting device without movable clamping jaws in a perspective view.
Figure 4:
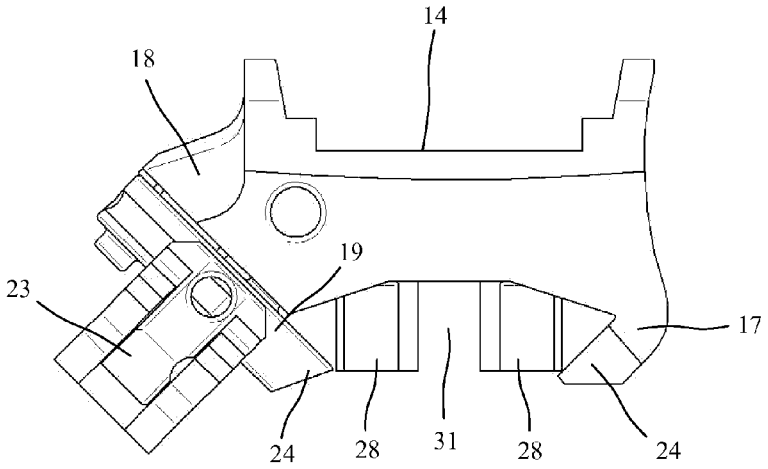
FIG. 4: the mounting device of FIG. 2 with movable clamping jaws in a side view.

In the embodiment example shown in FIG. 1, the attachment device comprises facing side recesses 6 for the engagement of the clamping jaws 17 and 19 shown in FIG. 4, as well as mutually separate recesses 9 formed as transverse grooves for the engagement of a recoil cleat 10 represented in FIG. 2. The housing 1 comprises on its upper side two mounting bases 11 and 12 which are mutually separate in the longitudinal direction of the housing 1, and on which in each case two facing recesses 6 are provided as well as two groove-shaped recesses 9 which extend transversely to the longitudinal axis of the housing 1 and which are separated from each other by a middle bar 13. The middle bar 13 here extends in the longitudinal direction of the housing 1. The recesses 6 are designed as side milled slots in the form of a circular arc. The recesses 9, which are configured as transverse grooves, are offset toward the front or the rear opposite the recesses 6 in the longitudinal direction of the housing 1. The recesses 9 can be produced in a simple manner, for example, using an end mill.

Figure 3:
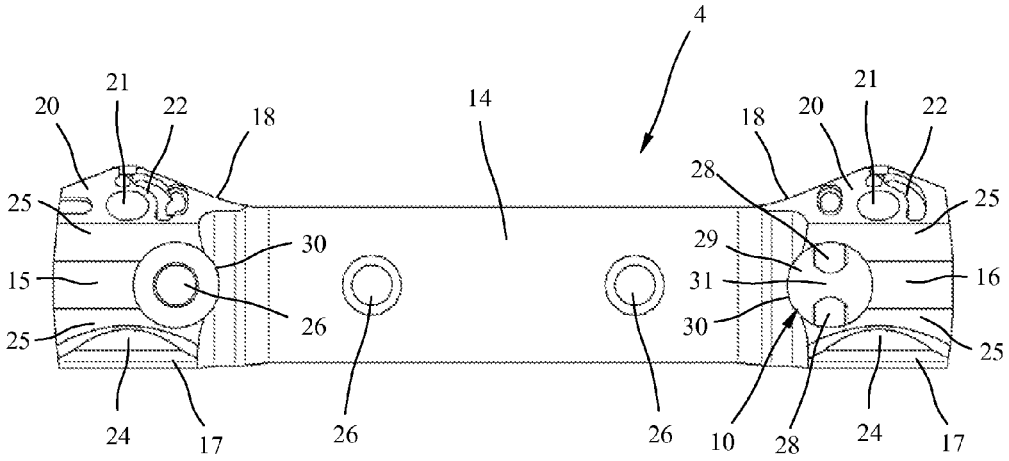
FIG. 3: the mounting device of FIG. 2 in a bottom view.

The mounting device 4 shown in FIGS. 2-4 in different views comprises a holding device 14 configured as a mounting bridge and having front and rear mounting portions 15 and 16 for setting on the mounting bases 11 or 12 of the housing 1. On the front and rear mounting portions 15 and 16 of the bridge-shaped holding device 14, a stationary clamping jaw 17 and a facing recess 18 for an adjustable clamping jaw 19 shown in FIG. 4 are provided in each case. The two recesses 18 comprise beveled outer faces 20 for the application of the adjustable clamping jaws 19 and the bores 21, as well as the grooves 22 for an attachment lever 23 shown in FIG. 4, or other elements for the actuation of the adjustable clamping jaws 19. Both the fixed clamping jaws 17 and also the adjustable clamping jaws 19 comprise, on the free ends thereof, semicircular clamping jaws 24, which are beveled on both sides, for engagement in the recesses 6, which are in the shape of a circular arc, on the housing—[sic] 1.

On the bottom side of the front and rear mounting portions 15 and 16, two beveled application faces 25, which are shown in FIG. 2, are provided for the application of the holding device 14 on the roof-shaped application faces 26 of the mounting bases 11 and 12, faces which can be seen in FIG. 1. In the bridge-shaped holding device 14, bores 27 are arranged for the attachment of ring holders or other holders for the attachment of the aiming telescope or of other aiming devices. Moreover, on the bottom side of the two mounting portions 15 and 16 of the holding device 14, a recoil cleat 10 with two mutually separate bar-shaped engagement elements 28 is provided in each case, for the positive-locking engagement in the two mutually separate groove-shaped recesses 9 on the housing 1.

As is apparent in particular from FIG. 3, the recoil cleat 10 comprises a round base body 29 which is inserted in a corresponding bore 30 on the bottom side of the bridge-shaped holding device 14. Between the two bar-shaped engagement elements 28, a slot 31 for receiving the middle bar 13, which is configured on the housing 1 of the handgun and which extends in the longitudinal direction of the housing 1, is provided. Due to the orientation of the middle bar 13 in the longitudinal direction of the housing 1, an accurate and precise connection and an additional lateral guidance between the mounting device 4 and the housing 1 occur, since the bar-shaped engagement elements 28 are led by the middle bar 13 extending in the longitudinal direction of the housing 1 for the positive locking engagement in the groove-shaped recesses 9.

The positive-locking engagement of the bar-shaped engagement elements 28 of the recoil cleat 10 occurs in such a manner that the bar-shaped engagement elements 28 like a bridge overlap the middle bar 13 extending in the longitudinal direction of the housing 1. An additional inner bore 26 for the attachment of, for example, ring-shaped, holders or other holding devices, can be covered by the round base body 29. The bar-shaped engagement elements 28 are rounded off on their mutually facing sides, so that they fit with the best possible positive-locking connection in the groove-shaped recesses 9 produced, for example, by an end mill.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. Mounting device configured for detachable attachment of an aiming device to a handgun with a holding device which comprises clamping jaws configured for the detachable attachment of the holding device to the handgun and at least one recoil cleat configured for positive locking engagement on the handgun, wherein the recoil cleat comprises two mutually facing and mutually separate engagement elements configured for engagement in two mutually separate recesses on the handgun wherein, between the engagement elements of the recoil cleat, a slot is formed for receiving a middle bar extending on the handgun in the longitudinal direction, and the recoil cleat with the engagement elements is formed like a bridge so the recoil cleat overlaps the middle bar.

2. Mounting device according to claim 1, wherein the recoil cleat comprises a base body arranged in a bore of the holding device.

3. Mounting device according to claim 2, wherein the engagement elements are formed on the base body.

4. Mounting device according to claim 1, wherein the engagement elements are formed in the shape of a bar and they are rounded off on their mutually facing sides.

5. Mounting device according to claim 1, wherein the engagement elements are offset toward the front or the rear, opposite the mutually facing clamping jaws in the longitudinal direction of the holding device.

6. Mounting device according to claim 1, wherein the holding device is formed in the shape of a mounting bridge with front and rear clamping jaws.

7. Housing of a handgun, which comprises an attachment device configured for a mounting device configured for detachable attachment of an aiming device, wherein the attachment device comprises two mutually separate recesses which are separated from each other by a middle bar, configured for the engagement of two mutually separate engagement elements of a recoil cleat, wherein the attachment device comprises two mounting bases separated from each other in the longitudinal direction of the housing, on which bases are provided in each case two facing recesses and two groove-shaped recesses, which extend transversely to the longitudinal direction of the housing and which are separated from each other in each case by a middle bar.

8. Housing according to claim 7, wherein the attachment device comprises facing side recesses for engagement of clamping jaws.

9. Housing according to claim 8, wherein the recesses are offset toward the front or the rear, opposite the recesses in the longitudinal direction of the housing.

10. Housing according to claim 7, wherein the middle bar extends in the longitudinal direction of the gun.

* * * * *